US009410298B2

(12) United States Patent
Kemper et al.

(10) Patent No.: US 9,410,298 B2
(45) Date of Patent: Aug. 9, 2016

(54) STRUCTURAL TUBE BASED MOVABLE VEHICLE CRASH BARRIER GATE

(71) Applicant: ROSS TECHNOLOGY CORPORATION, Leola, PA (US)

(72) Inventors: Steven L. Kemper, Lancaster, PA (US); Jay P. Otto, Lititz, PA (US); Timothy J. Manzella, Macungie, PA (US); Scott E. Espensen, Lancaster, PA (US)

(73) Assignee: ROSS TECHNOLOGY CORPORATION, Leola, PA (US)

( * ) Notice: Subject to any disclaimer, the term of this patent is extended or adjusted under 35 U.S.C. 154(b) by 0 days.

(21) Appl. No.: 14/932,896

(22) Filed: Nov. 4, 2015

(65) Prior Publication Data

US 2016/0053449 A1 Feb. 25, 2016

Related U.S. Application Data

(63) Continuation-in-part of application No. 14/331,244, filed on Jul. 15, 2014, now Pat. No. 9,347,191.

(51) Int. Cl.
*E01F 13/04* (2006.01)
*E01F 13/12* (2006.01)

(52) U.S. Cl.
CPC ..... *E01F 13/048* (2013.01); *E01F 13/12* (2013.01)

(58) Field of Classification Search
CPC ..... E01F 13/048; E01F 13/12
USPC ..... 404/6, 9, 10, 11; 256/13.1
See application file for complete search history.

(56) References Cited

U.S. PATENT DOCUMENTS

| | | | |
|---|---|---|---|
| 5,271,183 | A | 12/1993 | Hahn et al. |
| 6,341,764 | B1 | 1/2002 | Conner |
| 6,557,831 | B2 | 5/2003 | Erwin |
| 7,037,028 | B1 | 5/2006 | Donohoe et al. |
| 7,427,055 | B2 | 9/2008 | Platt |
| 8,657,526 | B2 | 2/2014 | Withers et al. |
| 2003/0213947 | A1 | 11/2003 | Takagi et al. |

FOREIGN PATENT DOCUMENTS

| | | | |
|---|---|---|---|
| FR | 2991346 | A1 | 12/2013 |
| GB | 2485412 | A | 5/2012 |

*Primary Examiner* — Raymond W Addie
(74) *Attorney, Agent, or Firm* — Patent Law Associates; Andrew D. Mead

(57) ABSTRACT

A vehicle crash barrier gate constructed primarily of structural tube members and having an energy-absorbing connection between horizontal movable gate member and vertical post members. The gate member is provided with one or more deformable flanges adjacent to each end. Each post includes a vertically extending channel for receiving a respective gate member end and the flanges. An inwardly facing, vertically aligned opening in each channel allows the gate member to extend therethrough and span the space between the posts. The vertical extent of the openings spans the required vertical movement of the gate member. One or more reinforcing elements are disposed on the posts proximate to the elevation at which the gate member is positioned to prevent vehicle passage to strengthen the vertical post structure. A drive apparatus is provided to move the gate member vertically between an open position, typically at grade level, and a closed position, typically elevated above grade level.

20 Claims, 5 Drawing Sheets

STRUCTURAL TUBE BASED MOVABLE VEHICLE CRASH BARRIER GATE

CROSS-REFERENCE TO RELATED APPLICATIONS

This application is a continuation in part application of application Ser. No. 14/331,244 filed on Jul. 15, 2014, the descriptive portions being incorporated by reference herein.

BACKGROUND OF THE INVENTION

Maintaining the security of sensitive facilities from terrorist attack or unauthorized entry is of great concern. This has led to the installation of a wide array of protective barrier designs meant to prevent an unauthorized vehicle or vehicles from penetrating the secured area, and to maximize the distance between a potentially explosive laden vehicle and the facility. Barrier protection includes both traditional vehicle access points and facility perimeters that might be vulnerable to a vehicle traveling overland.

The design of crashworthy barrier gates is further complicated by the need provide at least two configurations, one for stopping a vehicle attempting to penetrate the gate and a second for selectively permitting a vehicle to pass through the gate as well as a convenient means for moving the gate between the two configurations. Energy absorbing features employed in fixed barrier designs are not always practical in movable barrier designs. Thus, the movable barrier designs tend to be more robust to withstand the impact energy and complex as the barrier must be movable to permit vehicle access. Both demands increase cost.

It would be advantageous to provide an alternative vehicle crash gate fabricated from standard shaped structural materials that could be easily installed around a desired area to be protected from vehicular intrusion and simply operated. Additional advantages would be realized by a vehicle crash gate system having an aesthetically pleasing appearance once installed. Still further advantages would be realized by a vehicle crash gate system requiring minimal maintenance once installed.

SUMMARY OF THE INVENTION

Accordingly, the present invention, in any of the embodiments described herein, may provide one or more of the following advantages:

It is an object of the present invention to provide a vehicle crash gate having a connection between horizontal and vertical members capable of withstanding anticipated vehicular impact loads. An elongate horizontal rail spanning the gate opening is provided with one or more deformable flanges adjacent to each end. Vertical members disposed on opposing sides of the gate opening each include a vertically oriented channel configured to receive the rail ends and flanges. The channels extend vertically for at least the distance necessary to move the horizontal rail between a position through which a vehicle may pass through the gate and a position which prevents vehicle passage. The vertical member is reinforced proximate to the raised rail position necessary to stop a vehicle for additional post strength. Upon vehicle impact, deformation of the flanges dissipates energy that would otherwise detach the connection between the horizontal rail and the vertical members.

It is a further object of the present invention to provide an energy dissipating connection for joining a horizontal rail member to a vertical post member in a vehicle crash barrier that incorporates deformable flanges attached adjacent to an end of the horizontal rail member which are engaged in a receiver in the post member that permits vertical movement of the horizontal rail member. The deformable flanges are configured to deform upon a vehicle impact with the rail member prior to significant deformation of the post member and the rail member to which the flanges are attached. Deformation of the flanges dissipates energy necessary to arrest vehicle movement with limited penetration into the secured area established by the crash barrier.

It is another object of the present invention to provide a vehicle crash barrier with a movable horizontal gate member having an energy-dissipating connection between the horizontal and vertical members that is easily operated. The horizontal gate member is provided with one or more deformable flanges adjacent to each end. Vertical post members each include a vertically extending channel for receiving the rail ends and flanges. The channels are configured to permit vertical movement of the gate member, but prevent the passage of the flanges through a channel opening. A drive apparatus is provided to raise and lower the gate member within the channels.

It is a further object of the present invention to provide a vehicle crash barrier having a vertically movable horizontal gate member that is durable in construction, inexpensive of manufacture, carefree of maintenance, easily assembled, and simple and effective to use.

These and other objects are achieved in accordance with the instant invention by providing a vehicle crash barrier gate constructed primarily of structural tube members and having an energy-absorbing connection between horizontal movable gate member and vertical post members. The gate member is provided with one or more deformable flanges adjacent to each end. Each post includes a vertically extending channel for receiving a respective gate member end and the flanges. An inwardly facing, vertically aligned opening in each channel allows the gate member to extend therethrough and span the space between the posts. The vertical extent of the openings spans the required vertical movement of the gate member. One or more reinforcing elements are disposed on the posts proximate to the elevation at which the gate member is positioned to prevent vehicle passage to strengthen the vertical post structure. A drive apparatus is provided to move the gate member vertically between an open position, typically at grade level, and a closed position, typically elevated above grade level.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "upward" or "downward" are used as a matter of mere convenience, and are relative to the generally level ground or any references to "horizontal" or "vertical" planes. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

The vehicle barrier at issue in this application is designed to withstand at least the testing requirements delineated in ASTM F2656, "Standard Test Method for Vehicle Crash Testing of Perimeter Barriers." The concepts of the instant invention may be used to create barriers that satisfy the requirements of other crash barrier standards, both existing and as may be developed in the future.

Figure 1:
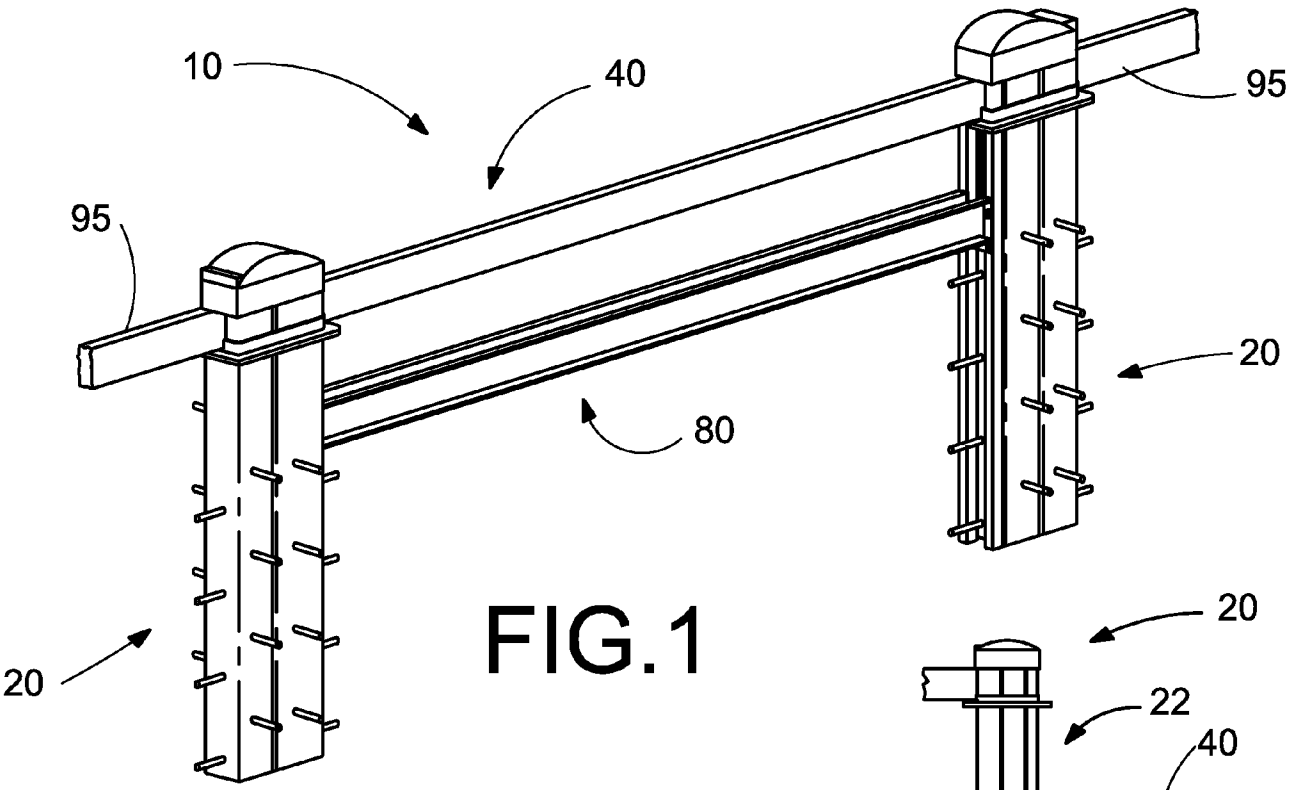
FIG. 1 in a perspective view of a movable vehicle crash barrier gate embodying aspects of the present invention shown in a raised or deployed configuration.
Figure 2:
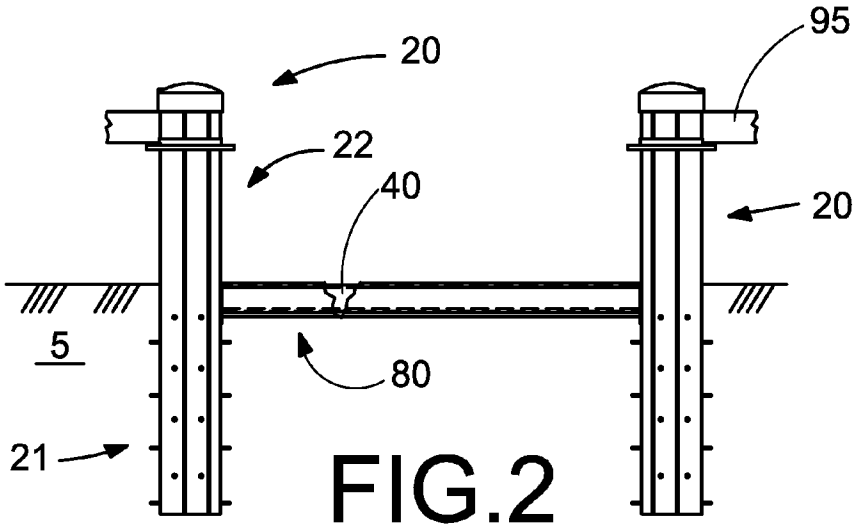
FIG. 2 is a partial elevation view of the movable gate of FIG. 1 shown in a lower configuration such as would permit the passage of a vehicle therethrough.
Figure 3:
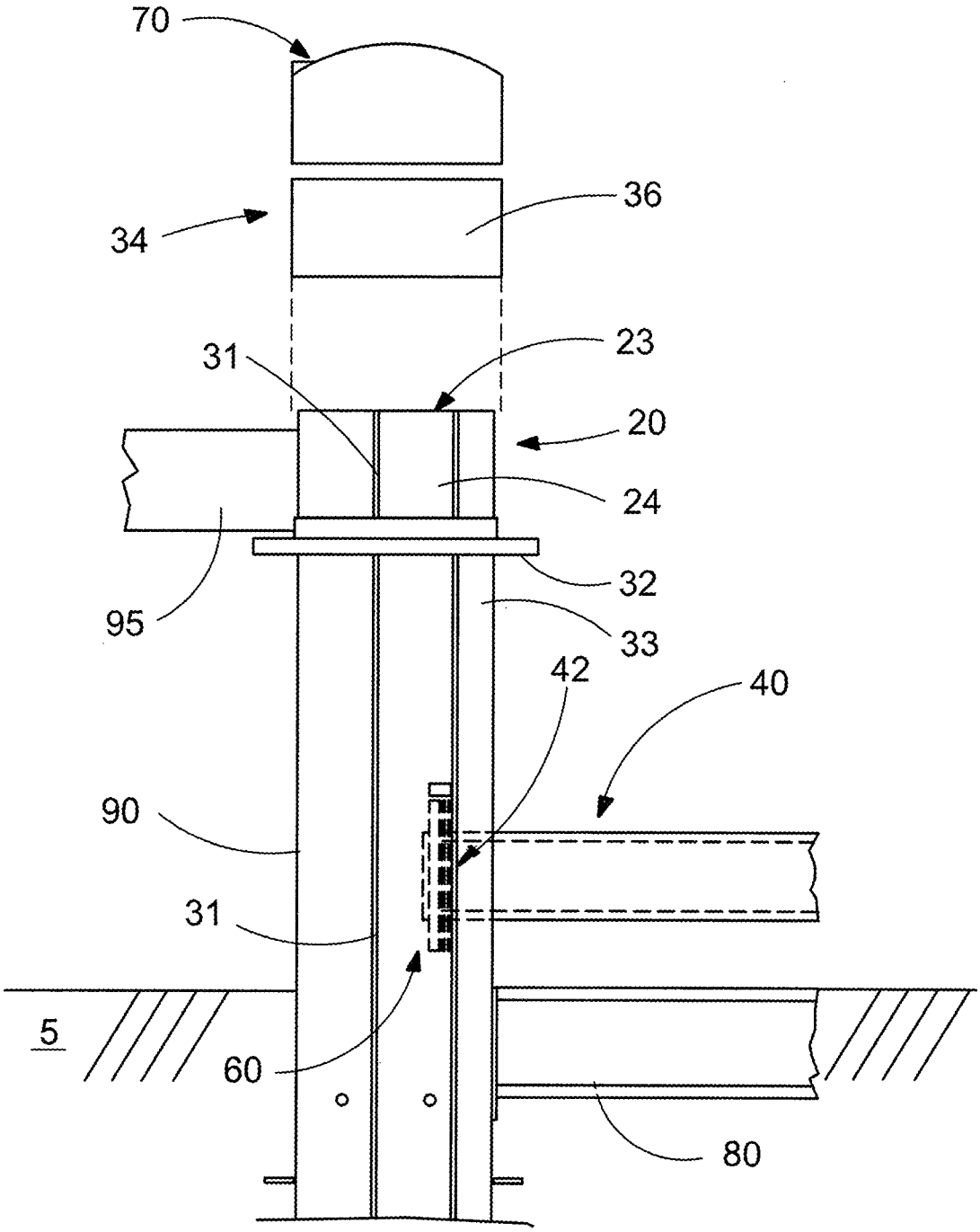
FIG. 3 is an exploded partial elevation view of a vertical post member shown illustrating the connection between post member and gate beam member wherein the gate beam member is in an intermediate vertical position.
Figure 4:
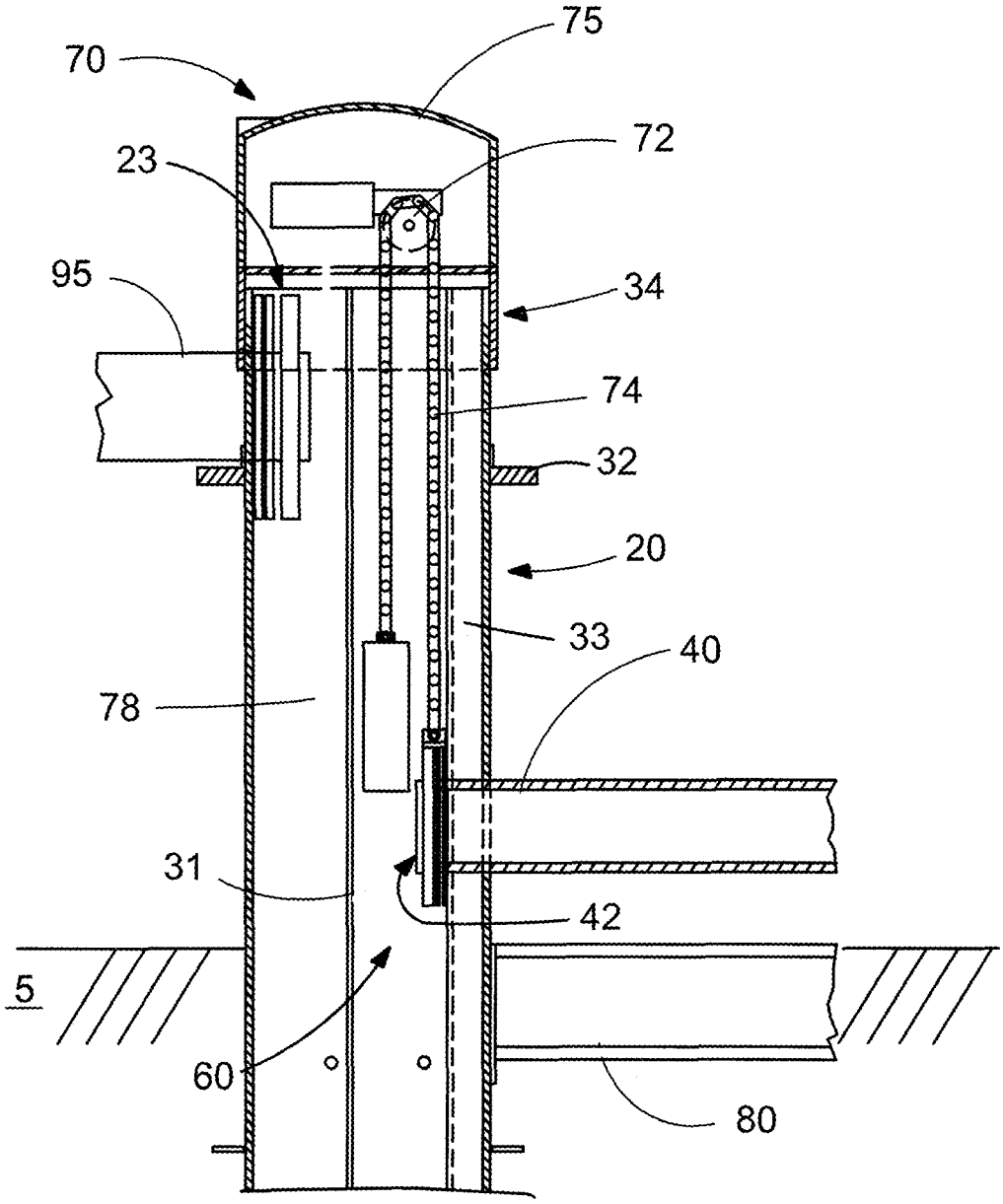
FIG. 4 is a cut-away elevation view of the post member of FIG. 3.
Figure 5:
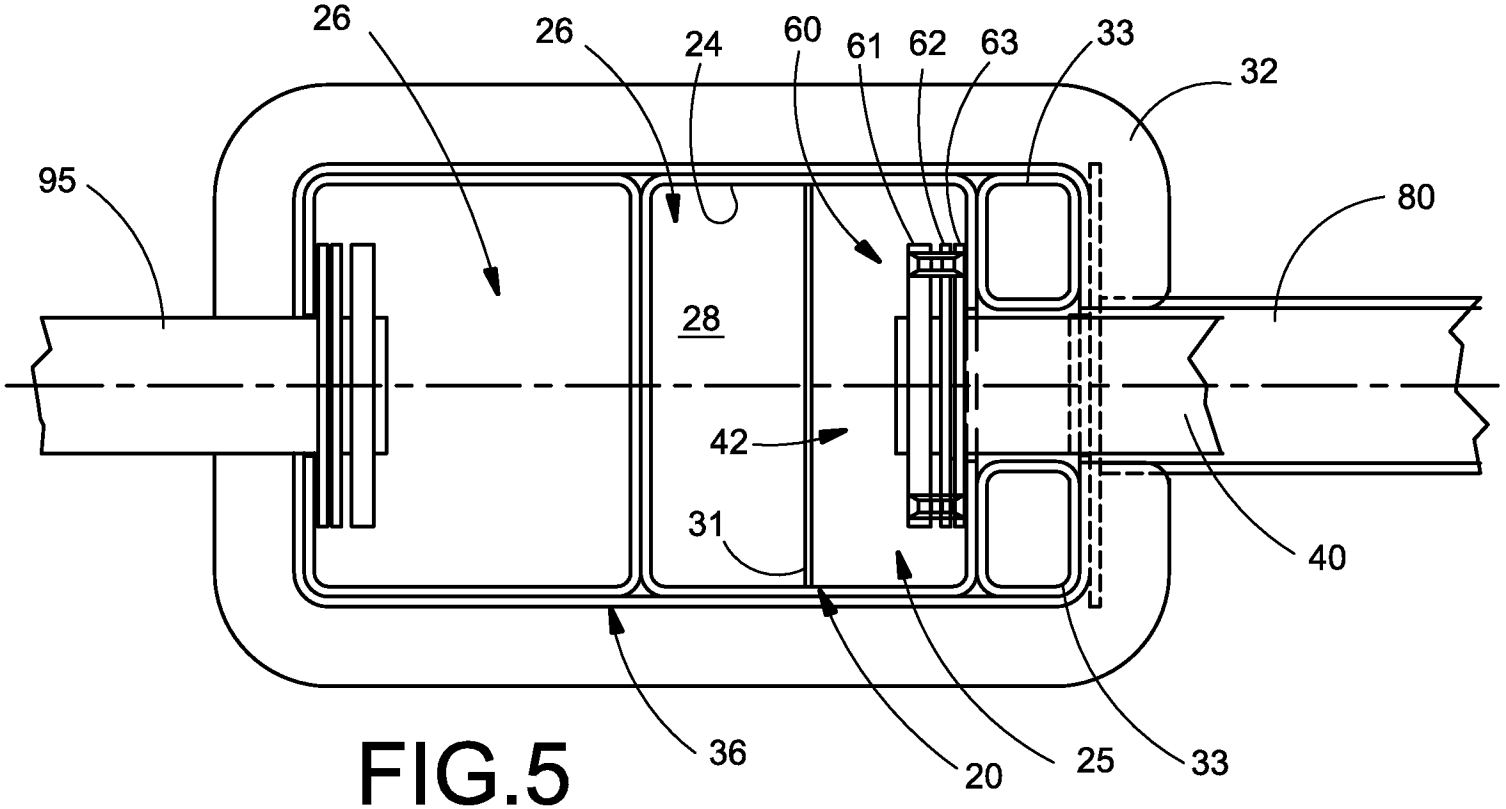
FIG. 5 is a plan view of one of the gate posts of the instant invention.
Figure 7:
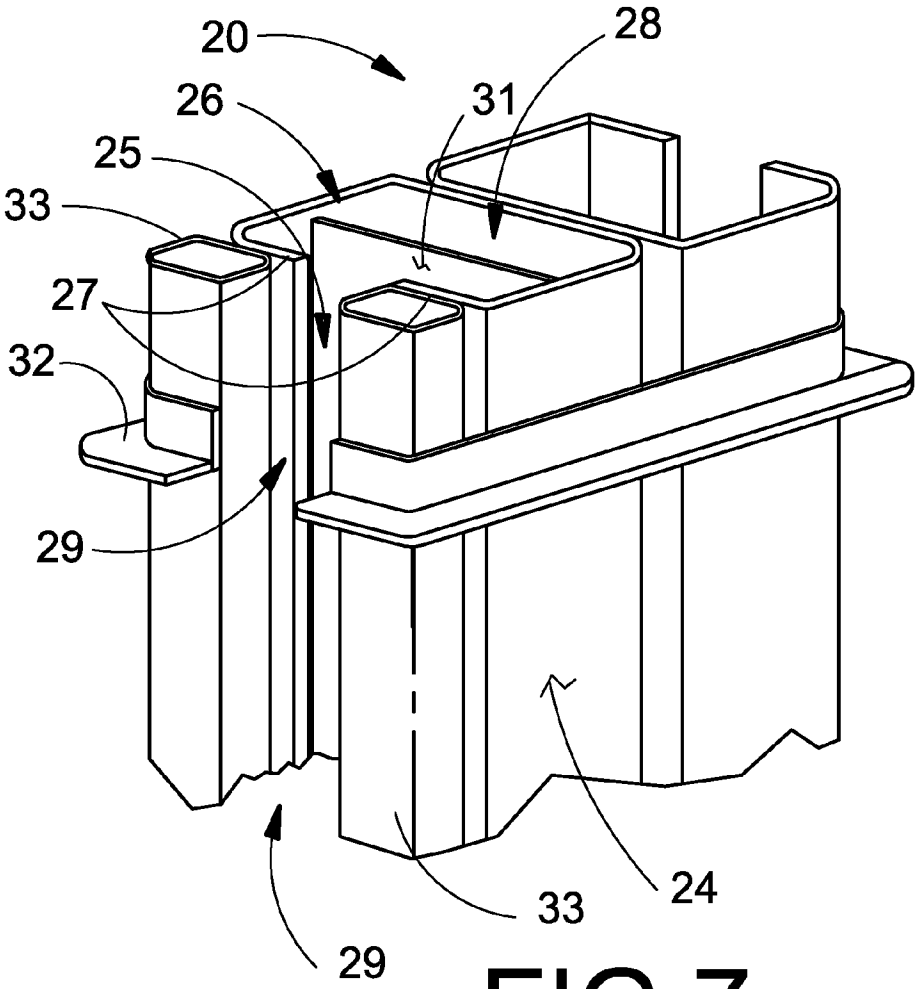
FIG. 7 is a partial perspective view of the upper end of the gate post member.
Figure 6:
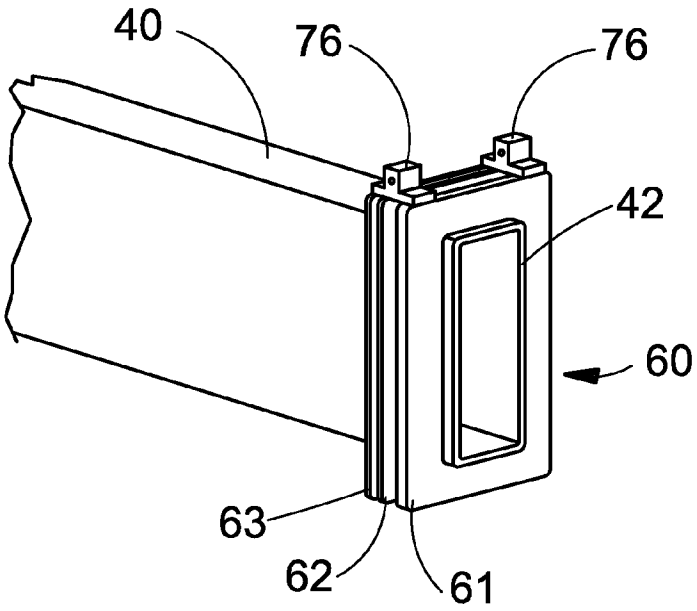
FIG. 6 is a partial perspective view of the end of the gate beam member showing the arrangement of the energy dissipating flanges.

Turning now to the drawings, FIGS. 1 through 7 illustrate aspects of an energy absorbing vehicle barrier gate 10 incorporating preferred embodiments of this invention. Referring to FIG. 1, the energy absorbing vehicle barrier 10 includes a pair of spaced-apart, upstanding gate post members 20 partially embedded in the ground 5 and a generally horizontally arranged movable gate beam member 40 extending between the two gate post members 20. The gate post members 20 may further be configured to permit connection of static rail members 95 in addition to the movable gate beam member 40 as part of a larger crash barrier system of limitless length or to close off potential vehicular entry paths adjacent to the gated opening. Details of the static fence post and horizontal beam member connection are provided in Applicant's co-pending application Ser. No. 14/331,244.

Each gate post member 20 includes an embedded portion 21 that extends below grade a sufficient amount to provide the necessary anchorage for the barrier gate 10. Concrete is typically used to reinforce the embedded portion anchorage. The embedded portion 21 may also include outward extending anchors and the like to better engage the concrete reinforcement material and further strengthen the post anchorage in the ground. An exposed portion 22 of each post 20 extends above the ground to elevate the movable gate member 40 to a desired elevation above the ground surface.

The gate post members 20 are preferably connected by a trough member 80 which spans the distance defining the gate opening width. The trough member 80 is vertically positioned at grade level and configured with a trough extending below grade level into which the gate beam member 40 may be positioned to allow vehicles to pass through the gate without damage to the gate beam member. The trough member 80 strengthens the barrier gate 10 structure by structurally connecting the gate posts. The connected gate posts 20 also establish the spacing between the posts to provide consistent spacing and parallel movement tracks for the movable gate member 40.

Each post member 20 is formed from a hollow structural tube having a side wall 24 partially surrounding an open interior cavity 26. The interior cavity 26 is open at the distal end 23 of the post member 20. The interior cavity 26 includes a generally C-shaped channel 25 that extends for the length of the exposed portion 22 and partially into the embedded portion 21. The channel 25 includes a travel slot 27 bounded on either side by bearing ends 29 defining an opening in the side wall 24 of the gate post member 20 through which the gate beam member 40 may protrude. The travel slots 27 on the adjacent gate post member is inwardly facing to permit each end of the gate beam member 40 to pass through a respective travel slot 27 so that both ends of the gate beam member are supported. Reinforcing members 33 may be provided to strengthen the bearing ends. Additional stiffening members 31 may be provided in the interior cavity 26 to further strengthen the post member 20 without impeding movement of the gate beam member 40 or its lifting apparatus.

A gate beam elevator 70 is provided for each gate post member 20 to vertically support the gate beam member 40 at a desired elevation above the ground and to manage vertical movement of the gate beam member between the raised and open positions. The elevator 70 is preferably disposed within a housing 75 connected to the top end of the post. Each beam elevator is operably connected by connectors 76 to a respective end 42 of the gate beam member 40 within the channel 25, typically with a chain 74 or the like operably connected with a driving apparatus 72 disposed proximate to the distal end 23 of the gate post for moving the chain and thereby moving the gate beam member 40. The interior cavity 26 preferably includes at least one divider member 31 to separate the channel 25 from a second interior cavity portion 28. In the embodiment shown, a counterbalance 78 travels within the second interior cavity portion 28 to offset the mass of the gate beam portion 40 and reduce the power necessary to move the gate beam.

Each end 42 of the gate beam member 40 includes one or more energy dissipating flanges 60 extending outwardly from the exterior surface of the gate member. In the embodiment shown, a generally non-deformable stop flange 61 is connected adjacent to the end 42 of the gate beam member. Inwardly disposed along the gate beam member 40 are additional deformable flanges 62, 63 as needed to provide the energy dissipation during a vehicle impact with the gate beam member 40. The flanges 60 are configured to fit within the channel 25 with the gate beam member 40 projecting through the travel slots 27 to the space between the gate posts 20 and allow the gate beam member 40 move vertically within the channels 25. The inward facing surface on the innermost flange 63 is adjacent to the interior surface of the bearing ends 29, and sized so that the flanges 60 will not pass through the travel slot 27 absent deformation of the flanges 60, the bearing ends 29, or both.

The distal end of the gate post 20 is reinforced by a top cap 34 which connects to the periphery of the distal end 23 and bridges the travel slot 27 to join the bearing ends 29. The top cap 34 includes a downwardly extending skirt 36 which is outwardly positioned in relation to the side wall 24 and any reinforcing members 33 to strengthen the top structure of the post and limit deformation of the bearing ends 29 of the side wall as the gate beam member is deflected during vehicular impacts. The top cap 34 also provides a convenient structure for attaching the gate beam elevator 70. The top cap 34 may be fastened into position using bolts or the like to prevent unintentional removal or dislodgement during an impact. To further strengthen the gate post 20, an external gusset 32 is provided at a vertical location on the gate post proximate to the vertical location of the gate beam member 40 when in the raised position. In the preferred embodiment, the gate beam member 40, when in the raised position, is vertically adjacently below the top cap 34 and adjacently above the external gusset 32.

In a preferred embodiment, the post and gate beam members are fabricated from hollow structural steel tube having a generally rectangular cross section. One such structural steel tube is manufactured in accordance with material specification ASTM A500. Wall thickness and external dimensions of the structural tube may be selected upon the desired vehicle stopping capability. The embedment depth of the post members, size of the embedded anchorage, and height of the rail member above the ground may also be varied to tailor the vehicle arresting capability of the vehicle barrier. In the exemplar embodiment, the gate post members are formed from 12×12×½ ASTM A500, Gr. B structural tube steel embedded 78 inches into the ground and the top end of the post extending 42 inches above the ground. The gate beam member is formed from 4×12×½ ASTM A500, Gr. B structural tube steel with the major axis vertically oriented with the longitudinal centerline of the gate beam positioned approximately 32 inches above the ground when the gate is in the raised position.

The deformable flanges 62, 63 and the stop flange 61 are fabricated from steel plate and welded to the structural tube. The thickness of the stop flange 61 preferably exceeds the wall thickness of the structural tube comprising the rail member 40. The relative sizing allows the relative order and magnitude of deformation of the various elements in the connection to be controlled during a vehicle impact. In the exemplar embodiment, the stop flange is fabricated from a 10×17 inch plate of 1-inch thick ASTM A-36 plate material welded to the rail. The plate extends beyond the outer periphery of the rail approximately 2⅜ inches, but allows the rail end with flanges to be inserted into the post member. The thickness of the deformable flanges 62, 63 is preferably less than the rail member wall thickness so that they will begin to deform upon vehicle impact to dissipate energy before substantial deformation the tube walls of the post member, rail member, or stop flange occurs. In the exemplar embodiment, the deformable flanges are fabricated from ¼-inch thick ASTM A-36 plate material welded to the rail. The dimensions of the deformable flanges are preferably the same as the stop plate.

When assembled, the deformable flanges 62, 63 are positioned inwardly adjacent to the bearing ends 29 of interior side wall 24 of the gate post member. The channel 25 is sufficiently sized in relation to the flanges 60 so that vertical movement in the channel is permitted without significant longitudinal movement (in the axis of the gate beam member). Longitudinal movement of the gate beam member 40 away from the post, such as that caused by a vehicular impact, is resisted by the deformable flanges 62, 63 in contact with the inwardly facing surfaces of the bearing ends 29. The bearing ends 29 are reinforced by the proximate top cap 34 with its downwardly extending skirt 36, reinforcing members 33, if provided, and the external gusset 32 to limit deformation of the bearing ends 29 as the deformable flanges 62, 63 begin to deform. Increasing tension forces in the gate beam member cause the outermost deformable flange 63 to deform, absorbing energy of the impact as the flange bends. As the impact load continues, the outermost flange 63 will eventually deflect until it contacts the adjacent deformable flange 62, which will then begin to deform, continuing to absorb energy of the impact. Continued deformation of the deformable flanges 62, 63 will eventually bring them into contact with the stop flange 61. The stop flange 61 is thicker than either of the deformable flanges (by a factor of four in the preferred embodiment). The stop flange 61 is also thicker than the wall thickness of the gate beam member 40; however, the stop flange may also be deformed dependent upon the magnitude of the vehicle impact. The number, sizing, and spacing of the deformable flanges may be varied to achieve the required energy dissipation. The stop flange prevents the rail member from disengaging from the post member unless the vehicle impact forces grossly exceed the material strength of the post and rail members.

Naturally, the invention is not limited to the foregoing embodiments, but it can also be modified in many ways without departing from the basic concepts. It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A vehicle barrier gate having a movable gate beam spanning between a pair of upright gate posts, the barrier gate comprising:

a pair of spaced-apart, upstanding gate posts each having a top end and at least one side wall defining an interior cavity;

an elongate gate beam having generally opposing ends defining a longitudinal axis therebetween;

at least one deformable flange attached adjacent to each end of the gate beam, the flange extending outwardly generally perpendicular to the longitudinal axis; and a vertically oriented gate receiver disposed in each gate post, each gate receiver having a pair of spaced apart bearing ends defining an opening through the at least one side wall through which a respective end of the gate beam may extend, the opening sized to inhibit passage of the at least one deformable flange therethrough and to permit vertical movement of the gate beam between generally opposing raised and lowered positions.

2. The barrier gate of claim 1, wherein each upstanding post further comprises at least one gusset extending outwardly from and partially encircling each gate post adjacent to the gate beam when in the raised position, the at least one gusset includes a gap aligned with the opening whereby the vertical movement of the gate beam is unimpeded.

3. The barrier gate of claim 2, further comprising a cap encircling the at least one side wall adjacent to the top end and spanning the opening between the bearing ends of the receiver.

4. The barrier gate of claim 3, wherein each end of the gate beam further comprises a stop flange disposed adjacent to the respective end of the gate beam between the respective end and the at least one deformable flange.

5. The barrier gate of claim 4, further comprising a trough member extending parallel to the longitudinal axis and connecting the pair of upstanding gate posts, the trough member configured to receive the gate beam in the lowered position.

6. The barrier gate of claim 1, further comprising an elevating apparatus configured to vertically move the gate beam between the raised and lowered positions.

7. The barrier gate of claim 6, wherein the elevating apparatus comprises an elevating mechanism disposed at each upstanding gate post, each elevating mechanism operably connected to respective ends of the gate beam in the respective gate receivers.

8. A structural tube based vehicle barrier gate having an energy absorbing connection comprising:

a pair of spaced apart generally upstanding elongate gate posts, each having a top end, an embedded end, at least one side wall defining a generally hollow interior cavity containing a receiver channel, each post configured to be partially ground embedded;

a hollow elongate gate beam having generally opposing ends defining a longitudinal axis therebetween, the gate beam spanning the space between the pair of gate posts; and at least one deformable flange attached adjacent to each end of the gate beam, the flanges extending outwardly generally perpendicular to the longitudinal axis; wherein each receiver channel includes a pair of generally spaced apart bearing ends defining an opening therebetween in the at least one side wall through which respective gate beam ends may extend, the opening sized to inhibit passage of respective at least one deformable flange therethrough and to permit vertical movement of the gate beam between generally opposing raised and lowered positions.

9. The barrier gate of claim 8, further comprising a trough member extending parallel to the longitudinal axis and connecting the pair of upstanding gate posts, the trough member configured to receive the gate beam in the lowered position.

10. The barrier gate of claim 9, wherein each upstanding post further comprises at least one gusset extending outwardly from and partially encircling each gate post adjacent to the gate beam when in the raised position, the at least one gusset includes a gap aligned with the opening whereby the vertical movement of the gate beam is unimpeded.

11. The barrier gate of claim 10, further comprising a cap encircling the at least one side wall adjacent to the top end and spanning the opening between the bearing ends of the receiver.

12. The barrier gate of claim 11, wherein each end of the gate beam further comprises a stop flange disposed adjacent to the respective end of the gate beam between the respective end and the at least one deformable flange.

13. The barrier gate of claim 8, further comprising an elevating apparatus configured to vertically move the gate beam between the raised and lowered positions.

14. The barrier gate of claim 13, wherein the elevating apparatus comprises an elevating mechanism disposed at each upstanding gate post, each elevating mechanism operably connected to respective ends of the gate beam in the respective gate receivers.

15. A vehicle barrier gate having a movable gate beam spanning between a pair of upright gate posts, the barrier gate comprising:

a pair of spaced-apart generally upstanding elongate gate posts, each having a top end, an embedded end, a side wall defining a generally hollow interior cavity, and a vertically aligned channel disposed in the interior cavity, the channel having a vertically aligned opening through the side wall, each post configured to be partially ground embedded; and a hollow elongate gate beam having generally opposing ends defining a longitudinal axis therebetween, each end of the gate beam having at least one deformable flange attached adjacently thereto, the at least one flange extending outwardly from the gate beam generally perpendicular to the longitudinal axis;

the gate beam being horizontally positioned between the gate posts such that each end and the respective at least one deformable flange is disposed within a respective channel and the beam extending through respective openings, the channels configured to permit vertical movement of the gate beam between generally opposing raised and lowered positions, the openings configured to prevent passage of respective at least one deformable flange therethrough.

16. The barrier gate of claim 15, further comprising an elevating apparatus configured to vertically move the gate beam between the raised and lowered positions.

17. The barrier gate of claim 16, wherein the elevating apparatus comprises an elevating mechanism disposed at each upstanding gate post, each elevating mechanism operably connected to respective ends of the gate beam in the respective gate receivers.

18. The barrier gate of claim 16, further comprising a trough member extending parallel to the longitudinal axis and connecting the pair of upstanding gate posts, the trough member configured to receive the gate beam in the lowered position.

19. The barrier gate of claim 17, wherein each upstanding post further comprises at least one gusset extending outwardly from and partially encircling each gate post adjacent to the gate beam when in the raised position, the at least one gusset includes a gap aligned with the opening whereby the vertical movement of the gate beam is unimpeded.

20. The barrier gate of claim 18, further comprising a cap encircling the at least one side wall adjacent to the top end and spanning the opening between the bearing ends of the receiver.

* * * * *